United States Patent [19]

Fujimaki et al.

[11] 4,104,135

[45] Aug. 1, 1978

[54] METHOD OF PRODUCING HIGHLY CORROSION RESISTANT TIN-PLATED STEEL SHEET

[75] Inventors: Taketoshi Fujimaki; Shoji Shijima; Shunichi Harada, all of Chiba, Japan

[73] Assignee: Kawasaki Steel Corporation, Kobe, Japan

[21] Appl. No.: 601,516

[22] Filed: Aug. 4, 1975

Related U.S. Application Data

[63] Continuation of Ser. No. 454,150, Mar. 25, 1974, abandoned.

[30] Foreign Application Priority Data

Apr. 3, 1973 [JP] Japan ..... 48-37395

[51] Int. Cl.[2] ..... C25D 5/10; C25D 5/50

[52] U.S. Cl. ..... 204/37 T; 204/37 R; 204/38 B; 204/40; 428/646; 428/647; 428/648

[58] Field of Search ..... 204/37 T, 37 R, 38 B, 204/40; 29/196.3, 196.4, 196.6; 428/646, 647, 648

[56] References Cited

U.S. PATENT DOCUMENTS

| | | | |
|---|---|---|---|
| 2,266,330 | 12/1941 | Nachtman | 204/28 |
| 2,381,778 | 8/1945 | Schoonmaker et al. | 204/37 T |
| 3,074,154 | 1/1963 | Pearson et al. | 29/196.4 |
| 3,260,580 | 7/1966 | Kamm et al. | 29/196.4 |
| 4,013,488 | 3/1977 | Ramqvist et al. | 204/37 R X |

*Primary Examiner*—G. L. Kaplan

[57] ABSTRACT

A method of producing a highly corrosion resistant tin-plated steel sheet is disclosed by which a metal or alloy coating having a thickness from 0.005μ to 0.5μ and selected from the class consisting of Ni, Cu and Ni-Sn alloy is plated upon a steel sheet. The thus plated steel sheet is heated in a non-oxidizing atmosphere to such an extent that said plated coating is penetrated and diffused into the steel sheet whereby a reformed steel sheet surface where said plating coating is disappeared is secured. A tin coating is then plated upon said reformed steel sheet surface. This reformed steel sheet surface is sandwiched between the plating tin coating and the steel sheet and contributes greatly to corrosion resistant property of the tin-plated steel sheet.

5 Claims, 7 Drawing Figures

METHOD OF PRODUCING HIGHLY CORROSION RESISTANT TIN-PLATED STEEL SHEET

This is a continuation of application Ser. No. 454,150 filed Mar. 25, 1974 and now abandoned.

This invention relates to methods of producing tin-plated steel sheets and more particularly to a method of producing a highly corrosion resistant tin-plated steel sheet for use in manufacturing cans for acid fruit juice and the like.

In general, a tin-plated steel sheet consists of a steel sheet, an alloy of the iron and tin, a tin layer, a passivation film and an oil coating. The function of each of these layers has been well known in the art.

Particularly, a covering ratio of the iron-tin alloy layer is the most essential element for determining a corrosion resistant property of the tin-plated steel sheet. If the tin-plated steel sheet is used to manufacture cans for acid fruit juice and the like, it is important that the steel sheet shall be compactly and uniformly covered with the iron-tin alloy layer in order to restrict the dissolution rate of tin, whereby the tin-plate can is given a longer shelf life.

In order to produce a highly corrosion resistant tin-plated steel sheet, a number of methods of modifying the iron-tin alloy layer have heretofore been proposed. All of these methods, however, are not always effective enough to improve the corrosion resistant property of the tin-plated steel sheet or could not always be applied in practice in an easy manner.

In addition, the conventional method in which the corrosion resistance of tin plate is mainly based on the iron-tin alloy layer was not enough for killed steel to obtain high corrosion resistance.

An object of the invention, therefore, is to provide a method which can provide a reformed steel sheet surface where a more compact and thinner alloy layer is obtained, and where a highly corrosion resistant tin plate which has lower dissolution rate of tin for use in manufacturing cans for acid fruits juice and the like is easily obtained.

A further object of the invention is to provide a method by which a highly corrosion resistant tin-plated steel sheet can be obtained starting not only from rimmed steel sheet but also from killed steel sheet.

A feature of the invention is the provision of a method of producing a highly corrosion resistant tin-plated steel sheet comprising the steps of plating a metal or alloy coating between 0.005$\mu$ and 0.5$\mu$ thick and consisting essentially of a metal or alloy selected from the class consisting of Ni, Cu and Ni-Sn alloy upon a steel sheet, heating the thus plated steel sheet in a non-oxidizing atmosphere to such an extent that said plating coating is penetrated and diffused into the steel sheet whereby a reformed steel sheet surface where said plates layer is disappeared is secured, and plating a tin coating upon said reformed steel sheet surface to secure a tin-plated steel sheet.

The invention is based on the recognition that if the above described reformed steel sheet surface is secured, the corrosion resistant property of the tin-plated steel sheet can significantly be improved.

It is ascertained that the invention is capable of utilizing as the starting steel sheet to be tin-plated not only rimmed steel sheet but also killed steel sheet and making both steel sheets highly corrosion resistant. The conventional method in which the corrosion resistance of tin plate is mainly based on the iron-tin alloy layer was not enough for killed steel to obtain a high corrosion resistance. As a result, the method according to the invention is superior to such conventional method.

The method according to the invention has the advantage that the above mentioned metal or alloy can be plated upon the surface of both rimmed steel and killed steel sheets such that the plating metal or alloy is completely penetrated and diffused into these steel sheets so as to form a reformed steel sheet surface whereby a galvanic current in corrosion caused by the electrical contact between the steel sheet surface and the tin layer in food can be decreased.

Another advantage of the invention is that this invention makes it possible to materially increase the corrosion resistant property of the matte finish tin-plated steel which is not subjected to the reflowing operation.

In accordance with the invention, an iron-tin alloy layer does not seem to be present at the interface between the finally plated tin layer and the steel sheet reformed in adequate condition. The steel sheet surface, however, is electrochemically reformed, and as a result, an electrode potential produced at the steel sheet is almost the same as that produced at the tin layer so that very small galvanic current flows even when the steel sheet is short circuited to the tin layer.

The invention will now be described in greater detail with reference to the accompanying drawings, in which:

FIG. 1 graphically illustrates the relation between the heating time required for completion of disappearing of plated Ni layer from the steel surface by penetrating and diffusing the plated Ni layer into the steel sheet so as to secure a reformed steel sheet surface and the thickness of the plating Ni layer in $\mu$ with the annealing temperature taken as a parameter;

FIG. 2 graphically illustrates the relation between ATC value in $\mu A/cm^2$ obtained by ATC test subjected to the tin-plated and reflowed steel sheet and the heating time at a heating temperature of 700° C with the thickness of the Ni coating layer taken as parameter and also the relation between the ATC value in $\mu A/cm^2$ obtained by the ATC test subjected to the tin-plated and reflow treated steel sheet without previously plated with the Ni coating layer and the heating time for the sake of comparison;

In one embodiment of the invention, a steel sheet is cold rolled to reduce it to a desired thickness, electrolytically cleaned, washed with water, slightly pickled and then again washed with water. The steel sheet thus cleaned is introduced into a plating cell to plate a metal coating having a given thickness and consisting essentially of a metal selected from the class consisting of Ni, Cu and Ni-Sn alloy directly upon the clean steel sheet. In this case, it is important that the steel sheet shall be compactly and uniformly covered with the plating metal or alloy.

As the plating operation, an electro-plating operation may preferably be effected. A substitution plating may also be effected with Ni, Cu and the like metals which are capable of effecting such substitution plating.

The previously plated steel sheet is washed with water, dried, immediately thereafter reeled, and then is heated in a non-oxidizing atmosphere to a temperature sufficient to alloy the plating metal or alloy with the steel sheet.

It has been found that the above-mentioned penetration and diffusion due to the heat treatment may be attained by a continuous annealing operation or a box type annealing operation which has commonly been applied to the steel sheet after it has been cold rolled.

The annealing time may be determined in dependence on the thickness of the plated metal and annealing temperature such that the plated metal layer is penetrated and diffused into the metal sheet in such an extent that a reformed steel sheet surface where the plating metal layer is substantially disappeared is secured.

Figure 1:
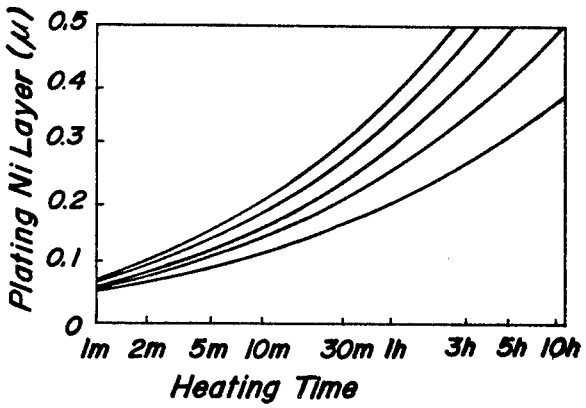

In FIG. 1 is graphically illustrated the relation between the heating time required for completing the disappearing of plated Ni layer from the steel surface by penetration and diffusion so as to secure a reformed steel sheet surface, with the thickness of the plating Ni layer and the annealing temperature taken as parameter. These heating times are confirmed by the result of experimental tests and the continuous annealing operation takes 1 min. to 10 min., while the box annealing operation takes 30 min. to 10 h. Whether or not the plating metal layer is remained on the steel sheet surface may be discriminated by peeling remained layer with the aid of a dilute acid a surface layer of the steel sheet after it has been heated to effect penetration and diffusion into the steel sheet and by subjecting the remained layer thus extracted to an electron diffraction.

Figure 2:
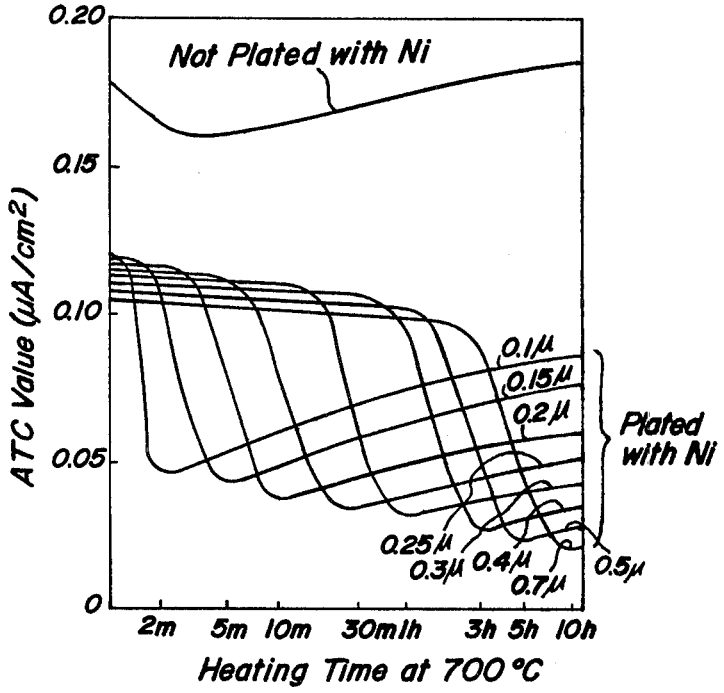

FIG. 2 is a graphic illustration of the relationship between the ATC value obtained by ATC test subjected to the tin-plated and reflowed steel sheets and the heating time at a heating temperature of 700° C with thickness of the Ni coating layer taken as a parameter. For the sake of comparison, in FIG. 2 also graphically illustrates the relation between the ATC value obtained by the ATC test subjected to a tin-plated and reflowed steel sheet without previously plated with the Ni coating layer and the heating time.

The ATC value (alloy-tin couple value) is the amount of the current flowing between a pure tin electrode and an electrode consisting of a piece of tin plate from which the free (unalloyed) tin has been removed to expose the iron-tin alloy expressed as $\mu$A (microamperes)/cm$^2$. The masurement is made after 20 h. exposure of the electrodes in a medium consisting essentially of deaerated grapefruit juice. The higher the corrosion resistance of tin plate the lower the ATC value.

As seen from FIG. 2. the ATC values of the Ni plated steel sheets are far superior to that of a steel sheet not plated with Ni. In addition, the ATC values of the Ni plates steel sheets are rapidly improved as the heating time lengthens and has a minimum value at a certain heating time while a further elongation of the heating time results in a gradual increase of the ATC values.

The inventors have found out that the time at which the ATC value becomes minimum is equal to the time at which disappearing of the platiı.g metal has been just completed.

In accordance with the invention, the previous metal coating must be limited in thickness to between 0.005$\mu$ and 0.5$\mu$. This is because of the fact that if the thickness of the previous metal coating is less than the lower limit 0.005$\mu$, such thin metal coating does not contribute to corrosion resistant property. Also if the thickness of the previous metal coating is thicker than the upper limit 0.5$\mu$, the heating operation must be effected for a longer time and is not economical and hence not applicable in practice. In addition, the use of the previous metal coating thicker than the upper limit 0.05$\mu$ is disadvantageous because non-diffused plating metal remains on the steel sheet surface even after the heating operation has been completed, thereby degrading the ATC value and exhibiting further disadvantages to be described later.

Whether or not the plating metal layer remains on the steel sheet surface after it has been heat treated can easily be confirmed by a technique such as electrolysis, X ray diffraction and the like.

Experimental tests have yielded the result that if the plating metal remains on the steel sheet surface after the heating penetration and diffusion operation has been effected, the following disadvantages are involved.

(1) Tin-plated steel sheet without being subjected to reflowing operation.

If the plating metal or alloy is completely penetrated and diffused into the steel sheet surface to secure a reformed steel sheet surface, the electrode potential of the steel sheet surface in a suitably adjusted organic acid such, for example, as grapefruit juice is almost equal or slightly lower than the electrode potential of tin. As a result, even when the tin is short circuited to the reformed steel sheet surface, substantialy no galvanic current flows between the tin electrode and the steel sheet electrode, whereby dissolution rate of tin is very small.

On the contrary, if the plated metal or alloy remains on the steel sheet surface, the electrode potential of the steel sheet surface in the above mentioned organic acid becomes less noble than that of the tin. As a result, if the tin is short circuited to the steel sheet surface, a rapid dissolution of the plating metal or alloy through pinholes or deteriorated portions of the tin layer into the organic acid occurs, thereby degrading the organic acid liquid.

(2) Tin-plated steel sheet subjected to reflowing operation.

Figure 3A:
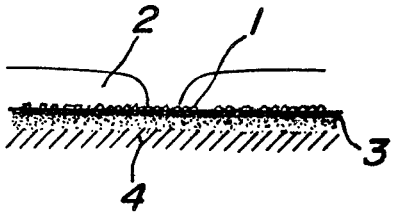
FIG. 3A shows schematically a section of a reformed steel sheet surface sandwiched between the plated tin layer and the steel sheet and secured by the method according to the invention.

A tin-plated steel sheet obtained from a steel sheet from surface of which a plating metal or alloy has just disappeared by penetration and diffusion forms a compact alloy layer at the interface between the plating tin layer and the reformed surface during reflowing operation. In FIG. 3A schematically showing a section of the reformed steel sheet surface, reference numeral 1 designates a compact alloy layer formed during reflowing, 2 a plating tin layer, 3 a reformed steel sheet surface and 4 a steel sheet.

Figure 4A:
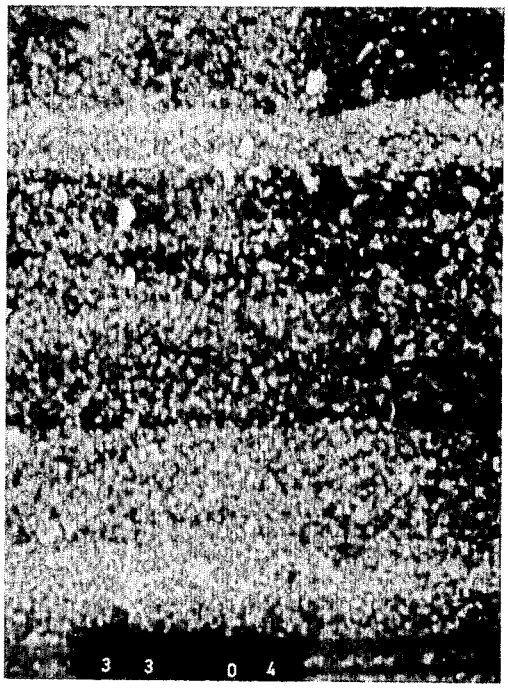
FIG. 4A shows a microscopic photograph of the reformed steel sheet surface shown in FIG. 3A in magnification 10,000X.

In FIG. 4A is shown a photograph of the compact alloy layer 1 shown in FIG. 3A taken by an electron microscope having a magnification 10,000X. As seen from FIGS. 3A and 4A, the reformed steel sheet 4 is covered with the compact alloy layer 1 which consists of extroardinary fine crystals.

As seen from FIG. 3A, even when the steel sheet 4 is exposed through pinholes eventually formed in the tin layers 2, the presence of the reformed steel sheet surface 3 and compact alloy layer 1 is capable of remarkably decreasing dissolution rate of tin. As a result, the tin-plated steel sheet produced by the method according to the invention has the advantage of improving its corrosion resistant property by the synergetic effect of the reformed steel sheet surface 3 and the compact alloy layer 1.

Figure 3B:
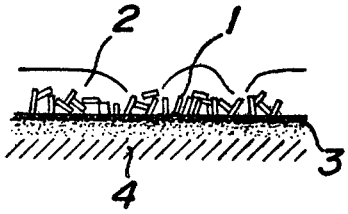
FIG. 3B shows schematically a section of a tin plate which is obtained after reflowing the tin plated steel sheet which had a remaining preplated metal or alloy layer because the preplated metal or alloy was too thick to complete of disappearing the preplated layer in certain heating condition.

In FIG. 3B is schematically shown a section of the tin plate which is obtained after reflowing by using the steel sheet where the plated metal or alloy layer remains on the steel sheet surface after the steel sheet has been subjected to heating operation.

In this case, the alloy layer formed has a loose structure and is black in color. This alloy layer 1 can be distinguished from the alloy layer 1 shown in FIG. 3A and can easily be rubbed off.

If tin is dissolved out of the inner surface of the can into food products to expose the alloy layer, it is not desirable that the alloy layer thus exposed is not attractive in color, and that if the alloy layer thus exposed when makes contact with the contents of the can, the contents of the can are deteriorated in appearance by contamination.

Such loose alloy layer does not contribute to the improvement on the corrosion resistant property of the tin-plated steel sheet. In addition, the surface tin of the tin-plated steel sheet is consumed by its alloying operation so as to reduce the free tin which can prevent the steel sheet against corrosion.

Moreover, the preplated metal remaining on the steel sheet surface results in a reduction of the tin crystal size of the tin-plated steel sheet after the reflowing operation. This minute division results in a deterioration of the corrosion resistant property of the tin-plated steel sheet.

Figure 3C:
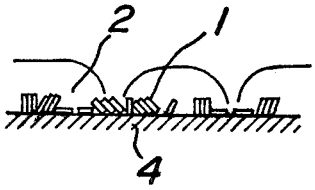
FIG. 3C shows schematically a section of a tin-iron alloy layer formed between the plating tin layer and the steel sheet and secured by the conventional method.

In FIG. 3C is schematically shown a section of a tin-iron alloy layer 1 of a conventional tin-plated rimmed steel sheet.

Figure 4B:
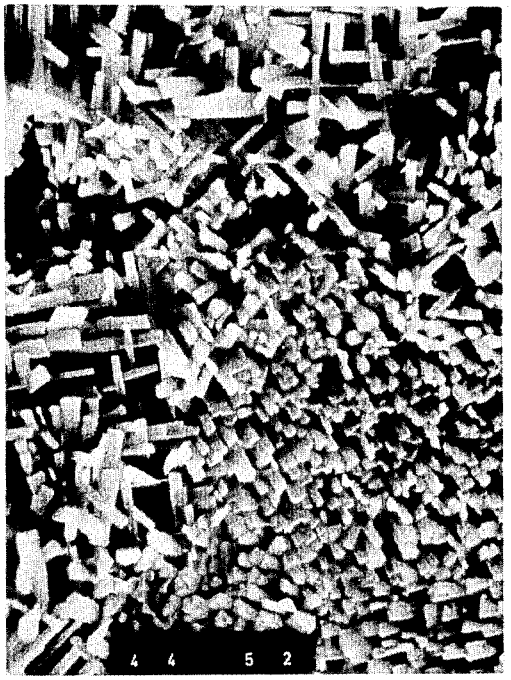
FIG. 4B shows a microscopic photograph of the conventional tin-iron alloy layer shown in FIG. 3C in magnification 10,000X.

In FIG. 4B is shown a photograph of the tin-iron alloy layer shown in FIG. 3C and taken by an electron microscope.

In the prior art technique by which Ni and the like is plated upon the steel sheet immediately before the tin-plating operation is effected, an alloy layer formed when the tin is subjected to the reflowing operation and is very weakly bound one which is black in color and easily rubbed off. In addition, the metal plated upon the steel sheet immediately before the tin-plating operation when heated at a temperature on the order of melting the tin only, is rapidly diffused into the melted tin, and as a result, substantially no diffusion of the plating metal into the steel sheet has occurred. Thus, the property of the steel sheet per se is not reformed at all. It is evident, therefore, such prior art technique of plating Ni and the like upon the steel sheet immediately before the tin-plating operation is different in idea and function from the method according to the invention.

The invention will now be described in greater detail with reference to practical examples.

EXAMPLE 1

A rimmed steel sheet was cold rolled, electrolytically cleaned, washed with water, slightly pickled, and then washed with water. The rimmed steel sheet thus treated was plated in a standard plating bath with a Ni coating of 0.1μ thick. This Ni-plated steel sheet was washed with water, dried and then subjected to a box type annealing operation at a temperature of about 650° C for 6 hours whereby the plating metal was completely penetrated and diffused into the steel sheet to provide a reformed steel sheet surface. A rimmed steel sheet treated as described above but without subjected to the Ni-plating operation was directly subjected to the above described box type annealing operation for the sake of comparison.

The above two rimmed steel sheets plated with and not plated with the Ni coating were electrolytically cleaned, washed with water, slightly pickled and then electroplated with a tin coating of 5.6 g/m$^2$ thick (one side) in a halogen bath, respectively.

These two tin-plated steel sheets were washed with water, dried, subjected to an electric resistance heating operation to heat and melt the tin coating and then subjected to a cathodic chemical treatment in sodium bichromate to provide two tin-plated steel sheets. ATC test (alloy-tin couple test), hot water test and Iron Solution Test were effected on these two tin-plated steel sheets, respectively, and the results thus obtained are shown in the following Table 1.

Table 1

| Kind of Samples | Test Results | | | |
|---|---|---|---|---|
| | ATC Value (μA/cm$^2$) | ISV* (μg/cm$^2$) | Number of Pinholes per 1 cm$^2$ | Tin Crystal Size |
| Tin-plated steel sheet treated by the method according to the invention | 0.050 | 0.06 | 0 to 10 | #8 |
| Tin-plated steel sheet for comparison | 0.150 | 0.35 | 30 to 50 | #8 |

*ISV (iron solution value) is the amount of iron dissolved expressed as μg(micrograms)/cm$^2$ when ISV test for measuring certain characteristics of electrolytic tin plate which affect internal corrosion resistance is effected. The ISV test involves the colorimetric determination of the total amount of iron dissolved when 3.14 in$^2$ of tin plate surface are exposed for 2 h. at 80 = 1° F to 50 ml of a mixture of dilute sulfuric acid ($H_2SO_4$), hydrogen peroxide ($H_2O_2$), and ammonium thiocyanate ($NH_4SCN$).

As seen from the above Table 1, the method according to the invention can considerably improve the corrosion resistant property and the like of the rimmed steel sheet.

EXAMPLE 2

A continuous moulded Al-Si killed steel sheet was cold rolled and then treated in the same manner as in the Example 1 to obtain two tin-plated steel sheets corresponding to those obtained in the Example 1.

These two tin-plated steel sheets were subjected to the same tests as those described in the Example 1. The test results thus obtained are shown in the following Table 2.

Table 2

| Kind of Samples | Test Results | | | |
|---|---|---|---|---|
| | ATC Value (μA/cm$^2$) | ISV (μg/cm$^2$) | Number of Pinholes per 1 cm$^2$ | Tin Crystal Size |
| Tin-plated steel sheet treated by the method | 0.040 | 0.06 | 0 to 10 | #8 |

Table 2-continued

| Kind of Samples | Test Results | | | |
|---|---|---|---|---|
| | ATC Value ($\mu A/cm^2$) | ISV ($\mu g/cm^2$) | Number of Pinholes per 1 $cm^2$ | Tin Crystal Size |
| according to the invention | | | | |
| Tin-plated steel sheet for comparison | 0.175 | 0.45 | 30 to 50 | #8 |

As seen from the above Table 2, the method according to the invention can significantly improve the corrosion resistant property and the like of the continuous moulded Al-Si killed steel sheet.

EXAMPLE 3

A rimmed steel sheet was cold rolled, electrolytically cleaned, washed with water, slightly pickled, and then washed with water.

The rimmed steel sheet thus treated was plated in a standard plating bath with a Ni coating of 0.5$\mu$ thick. This Ni-plated steel sheet and another steel sheet not plated with Ni were washed with water, dried and then subjected to a box type annealing operation at a temperature of 700° C for 6 hours whereby the plating metal was completely penetrated and diffused into the steel sheet.

The rimmed steel sheets treated as above described were further electrolytically cleaned, washed with water, slightly pickled, washed with water and then electroplated with a tin coating at 5.6 g/$m^2$ thick (one side) in a halogen bath.

These tin-plated steel sheets were subjected to a reflowing operation by electric resistance heating and then subjected to a cathodic chemical treatment in sodium bichromate to provide two tin-plated steel sheets.

ATC test, hot water test and iron solution test were effected on these two tin-plated steel sheets, respectively, and the results thus obtained are shown in the following Table 3.

Table 3

| Kind of Samples | Test Results | | | |
|---|---|---|---|---|
| | ATC Value ($\mu A/cm^2$) | ISV ($\mu g/cm^2$) | Number of Pinholes per 1 $cm^2$ | Tin Crystal Size |
| Tin-plated steel sheet treated by the method according to the invention | 0.024 | 0.05 | 0 to 10 | #8 |
| Tin-plated steel sheet for comparison | 0.190 | 0.31 | 30 to 50 | #8 |

EXAMPLE 4

A rimmed steel sheet was cold rolled, electrolytically cleaned in an alkaline liquid, washed with water, slightly pickled, and then washed with water.

The rimmed steel sheet thus treated was plated in a standard copper pyrophosphate plating bath with a Cu coating of 0.10$\mu$ thick. These Cu-plated steel sheet were washed with water, dried and then heated at 700° C for 1 minute, 2 minutes and 5 minutes, respectively, so as to penetrate and diffuse the plating metal into the steel sheet in different extents.

These rimmed steel sheets plated with the Cu coating and treated as above described were further electrolytically cleaned, washed with water, slightly pickled, washed with water and then electroplated with a tin coating of 5.6 g/$m^2$ thick (one side) in a halogen bath.

These tin-plated steel sheets were subjected to a reflowing operation by electric resistance heating.

The ATC test was subjected to these tin-plated steel sheets.

The results thus obtained are shown in the following Table 4.

Table 4

| | Heating times | | |
|---|---|---|---|
| | 1 minute | 2 minutes | 5 minutes |
| ATC Values ($\mu A/cm^2$) | 0.120 | 0.045 | 0.055 |
| Tin Crystal Size | #12 | #9 | #9 |

It was recognized by electron diffraction that the plating Cu layer was remained on the steel sheet surface after it was heated for 1 minute only, and that this plating Cu was disappeared from the steel sheet surface to provide a reformed steel sheet surface when it was heated for 2 minutes and 5 minutes, respectively, and the ATC values become substantially minimum.

EXAMPLE 5

A rimmed steel sheet was cold rolled, electrolytically cleaned in an alkaline liquid, washed with water, slightly pickled, and then washed with water.

The rimmed steel sheet thus treated was plated in a plating bath having the following composition under the following plating condition with a Ni-Sn alloy (Sn 65%) coating of 0.10$\mu$ thick.

| | |
|---|---|
| Plating bath composition: | |
| Nickel chloride (Hexahydrate) | 250 g/l |
| Stannous chloride (Dihydrate) | 50 g/l |
| Acidic ammonium fluoride | 50 g/l |
| Plating condition: | |
| pH | 2.7 |
| Bath temperature | 65° C |
| Current density | 2.7 A/$dm^2$ |

These Ni-Sn alloy-plated steel sheets were washed with water, dried and then heated at 700° C for 1 minute, 2 minutes and 5 minutes, respectively, so as to penetrate and diffuse the plating alloy into the steel sheet in different extents.

These steel sheets plated with the Ni-Sn alloy coating and treated as above described were further electrolytically cleaned, washed with water, slightly pickled, washed with water and then electroplated with a tin coating of 5.6 g/$m^2$ thick (one side) in a halogen bath.

These tin-plated steel sheets were subjected to a reflowing operation by electric resistance heating.

The ATC test was subjected to these tin-plated steel sheets.

The results thus obtained are shown in the following Table 5.

Table 5

| | Heating times | | |
|---|---|---|---|
| | 1 minute | 2 minutes | 5 minutes |
| ATC Values ($\mu A/cm^2$) | 0.160 | 0.050 | 0.070 |
| Tin Crystal Size | #12 | #9 | #9 |

It was recognized by electron diffraction that the plating Ni-Sn alloy was remained after it was heated for 1 minute only, and that this plating Ni-Sn alloy was disappeared from the steel sheet surface to provide a reformed steel sheet surface when it was heated for 2 minutes and 5 minutes, respectively.

What is claimed is:

1. A method for producing a highly acid corrosion resistant tin-plated steel sheet having a reduced ATC value when compared to conventional tin-plate comprising:

electroplating a coating selected from the group consisting of nickel, copper and nickel-tin alloy upon a steel sheet said coating having a thickness immediately after coating of between 0.005$\mu$ and 0.5$\mu$;

heating the plated steel sheet in a non-oxidizing atmosphere to completely diffuse the coating, enable the coating to penetrate the surface and to allow for reformation of the steel sheet surface so that the plating metal layer has substantially disappeared from said surface; and electroplating a tin coating on the reformed steel sheet surface to produce a tin-plated steel sheet.

2. A method of producing a highly corrosion resistant tin-plated steel sheet as claimed in claim 1 wherein said heating step is effected by means of continuous annealing operation at a temperature from 600° C to 800° C for 1 minute to 10 minutes.

3. A method of producing a highly corrosion resistant tin-plated steel sheet as claimed in claim 1 wherein said heating step is effected by means of box type annealing operation at a temperature from 600° C to 800° C for 30 minutes to 10 hours.

4. A method of producing a highly corrosion resistant tin-plated steel sheet as claimed in claim 1 wherein said heating step is effected at a temperature from 600° C to 800° C for a time at which disappearing of the plating metal layer has just been completed.

5. A method of producing a highly corrosion resistant tin-plated steel sheet as claimed in claim 1 and further comprising a step of reflowing after said tin plating operation.

* * * * *